US010945472B2

(12) United States Patent
Macrae

(10) Patent No.: US 10,945,472 B2
(45) Date of Patent: Mar. 16, 2021

(54) POCKET SYSTEM TO COMBINE THE FUNCTIONALITY OF A BAG AND APPAREL

(71) Applicant: SKAPYA LTD., Perranporth (GB)

(72) Inventor: Duncan Macrae, Perranporth (GB)

(73) Assignee: SKAPYA LTD., Perranporth (GB)

( * ) Notice: Subject to any disclaimer, the term of this patent is extended or adjusted under 35 U.S.C. 154(b) by 377 days.

(21) Appl. No.: 14/905,766

(22) PCT Filed: Jul. 16, 2014

(86) PCT No.: PCT/EP2014/065319
§ 371 (c)(1),
(2) Date: Jan. 15, 2016

(87) PCT Pub. No.: WO2015/007805
PCT Pub. Date: Jan. 22, 2015

(65) Prior Publication Data

US 2016/0174633 A1 Jun. 23, 2016

(30) Foreign Application Priority Data

Jul. 17, 2013 (EP) ..... 13176893

(51) Int. Cl.
*A41D 15/04* (2006.01)
*A45F 3/04* (2006.01)
*A45F 4/12* (2006.01)

(52) U.S. Cl.
CPC ..... *A41D 15/04* (2013.01); *A45F 3/04* (2013.01); *A45F 4/12* (2013.01); *A41D 2400/422* (2013.01)

(58) Field of Classification Search
CPC .. A41D 15/04; A41D 2400/422; A41D 15/00; A45F 4/12; A45F 2003/045
USPC ..... 224/153, 582, 647
See application file for complete search history.

(56) References Cited

U.S. PATENT DOCUMENTS 5,165,111 A 11/1992 Lieberman
5,526,969 A * 6/1996 Greenberger ..... A41D 15/04 2/69.5

(Continued)

FOREIGN PATENT DOCUMENTS

DE 20301935 U1 4/2003
DE 102004006395 A1 8/2005

(Continued)

OTHER PUBLICATIONS

Preliminary Report on Patentability, dated Jan. 28, 2016, issued in International Application No. PCT/EP2014/065319, filed Jul. 16, 2014.

(Continued)

*Primary Examiner* — Katharine G Kane
(74) *Attorney, Agent, or Firm* — Wiley

(57) ABSTRACT

A pocket system that integrates a bag and apparel, including a fabric storage compartment when in use as a bag, and a bag component storage compartment when in use as apparel, with a continuous compartment for storing items while as a bag, apparel and through conversion from bag to apparel and vice versa. When in a bag embodiment, the fabric of the apparel is drawn out of the fabric storage compartment, inverting said compartment, forming a new compartment into which the bag components are drawn and stored. When in apparel mode, the process is reversed to complete the transformation, i.e. the bag components are removed from the storage pocket, drawing the apparel material into the newly formed pocket.

13 Claims, 8 Drawing Sheets

(56) References Cited

U.S. PATENT DOCUMENTS

| | | | | |
|---|---|---|---|---|
| 7,363,569 | B2 * | 4/2008 | Pendakur | H04H 60/11 714/748 |
| 7,374,071 | B2 * | 5/2008 | Lavelle | A41D 3/08 2/94 |
| 8,820,596 | B1 * | 9/2014 | Bergquist | A45F 4/02 224/153 |
| 2006/0000004 | A1 * | 1/2006 | Elen | A41D 3/00 2/108 |
| 2009/0205102 | A1 | 8/2009 | Anderson | |

FOREIGN PATENT DOCUMENTS

| | | | |
|---|---|---|---|
| EP | 0 2228 767 | A2 | 7/1987 |
| EP | 2 179 675 | A1 | 4/2010 |
| EP | 2826399 | A1 | 1/2015 |
| WO | 96/02163 | A1 | 2/1996 |

OTHER PUBLICATIONS

International Search Report and Written Opinion, dated Dec. 23, 2014, in International Application No. PCT/EP2014/065319, filed Jul. 16, 2014.

Extended European Search Report, dated Oct. 15, 2013, in related European Patent Application No. 13176893.9, filed Jul. 17, 2013.

Great Britian Intellectual Property Office Search Report, dated Nov. 12, 2014, in related Great Britain Application No. GB1412663.5, filed Jul. 16, 2014.

* cited by examiner

POCKET SYSTEM TO COMBINE THE FUNCTIONALITY OF A BAG AND APPAREL

The present invention relates to a pocket system that allows a bag to be converted into an item of apparel. More particularly relating to the conversion of a bag into a wearable poncho, jacket or the like, whereby the contents of the bag do not have to be removed during the transformation and are continually accessible both as a bag and as apparel.

The usefulness of bags for carrying items has long been recognized. Many bag designs are commercially available. Such bags may be as simple as and hand held sack or may be a complex rucksack with a rigid frame, fabric container attachable to the frame and having numerous pockets, a myriad of adjustment straps, waist-strap and shoulder straps. Such bags are complex, relatively heavy, and time-consuming to fabricate. Rucksacks and waist bags are widely used for carrying items by people taking part in outdoor activities Common experiences of travellers, and folk who enjoy the outdoors are the normal changeability of weather conditions, the need to travel light and save space when packing. In the prior art, in contrast to the proposed invention, designs that convert apparel into an apparel storage bag are widely proposed; for example, U.S. Pat. No. 6,564,388 to Poston, wherein the apparel is configured to be folded into a carry bag which may be hand-carried or, alternatively be located within a separate pack which is placed within the inside front of the apparel. The design requires carrying of the separate pack in the front of one's person, which is very uncomfortable, and/or handcarrying of the bag, which will occupy one of the person's hands. This is very 25 inconvenient, inasmuch as people who are engaged in hiking, climbing, skiing, fishing, hunting, shopping, or other common outdoor activities will not want to have only one hand available for these activities.

Another example is found in DE20301935 to Vogt, which includes a backpack, comprising a folded waterproof jacket stored in a rear pocket and permanently attached to a rucksack.

Another type of apparel carrying container is found in U.S. Pat. No. 4,689,831 to Greenberger et al., in which a backpack with shoulder straps is attachable to the outer back panel of a jacket. The jacket may be folded and placed in the backpack, and the straps used to carry the backpack. When worn as a jacket, the backpack portion is always a conspicuous "hump" on the back of the wearer.

In U.S. Pat. No. 2,825,902 to Breier, a jacket is shown in which a pocket is formed between the arm holes and neck i.e. the two-ply yoke area by 5 sewing a generally triangular panel to the exposed surface of the inside jacket lining. A zipper located at the bottom of the pocket provides access thereto from within the jacket. The zipper is inaccessible when the jacket is worn. The jacket can be folded into the pocket to form a closed carrying case for hand carrying.

In U.S. Pat. No. 4,483,469 to Arisland, a vest is shown which is foldable into two separate attached containers which are joinable into a purse. In DE 102004006395 a jacket or coat, comprising straps or belt for being attached to the body when taken off on a hot day is shown.

U.S. Pat. No. 5,123,117 to Prendergast depicts a reversible jacket in which a backpack is attached to the outer surface of the jacket back. When the jacket is reversed, the backpack is hidden within the jacket. The jacket may be folded against the backside of the backpack and covered by a flap normally rolled up at the bottom of the backpack.

In U.S. Pat. No. 4,404,687 to Hager, a pullover jacket is configured to collapse into a handbag for carrying. The empty handbag is attached to the inner front of the jacket, and includes strap handles.

U.S. Pat. No. 2,058,474 of Long describes a apparel with an integral carrying bag with two handles, mounted on the interior of the back panel of a apparel. Matching zipper strips surround the bag opening. This arrangement has a definite disadvantage in that the sharp exposed (i.e. open) zippers tend to catch and tear apparel worn beneath the outer apparel. A similar construction is shown in U.S. Pat. No. 2,146,243 to Aug.

U.S. Pat. No. 2,292,347 to Bailey shows a apparel having a hanging panel attached to the inside back of a apparel by a central horizontal sew-line. The panel has opposed matching zippers at the top and bottom edges. The apparel may be folded up against the hanging panel and the zippers closed to enclose the apparel. The hanging panel with exposed zippers is seen to be uncomfortable, and it is well known that free (unclosed) zippers tend to catch on fabric which they touch.

In U.S. Pat. No. 2,324,722 to Papierniak, a jacket is shown having a front pocket within which is attached a lined tab with buttonholes. Matching buttons are attached within the pocket. When the tab is pulled from the pocket and the apparel carefully folded about the exterior of the pocket, the pocket may be inverted about the jacket to form a package.

U.S. Pat. No. 4,502,155 to Itoi describes outerwear having a complex structure for enclosing the outerwear in a backpack. The backpack is formed of two layers sewn along the upper edge to the back of a apparel and held by "engaging members" such as snaps at the bottom corners. Thus, the backpack hangs generally loosely from the jacket back. The backpack has multiple zippers, chuck webs, engaging members and connectors. Shoulder straps are attached to the inside surface of the jacket back.

Another complex backpack design in the prior art is found in U.S. Pat. No. 4,476,587 to Itoi. The jacket is bisected transversely by front and back zippers. When these zippers are opened, the jacket is divided into a top portion and a bottom portion. The front and 15 back zippers may then be joined to form an upside down bag. The bag may be pulled closed by strings sewn into the bottom edge of the jacket, and the exposed strings used to carry the bag.

An upper body rucksack and integral apparel design in the prior art is found in U.S. Pat. No. 8,032,948 to Anderson. The apparel has a rear mounted rucksack, contained on the inside of the apparel with vertical zippers allowing access to one pocket from the inside, outside or though insulated layers.

Each of the above-described prior art references, and many others that have not been described here, have disadvantages in complexity of construction, complexity of use, inconvenience in use, poor appearance, and/or lack of achieving the desired goals. A design whereby apparel can be converted into an apparel pack with straps to aid carriage does not function effectively as a bag, as the design does not permit access to the contents of the bag in both states—as a apparel and as a bag. In such cases, the contents of the bag must be removed through conversion, or are accessed awkwardly through other openings where the stored items are kept with the bag peripherals (straps and the like). None of the prior art references describe a simply transformable pocket design that allows the constant access to a designated storage compartment.

| Cited Patent | Filing date | Publication date | Applicant | Title |
|---|---|---|---|---|
| DE20301935 | Feb. 7, 2003 | Oct. 4, 2003 | Vogt Michaela | Backpack, comprising folded waterproof jacket stored in rear pocket and permanently attached to rucksack |
| DE 102004006395 | Apr. 6, 2004 | Aug. 8, 2005 | Jekel, Nina | Jacket or coat, comprising straps or belt for being attached to body when taken off on hot day |
| U.S. Pat. No. 2,058,474 | May 21, 1936 | Oct. 27, 1936 | Long John R | Combined apparel and carrying bag |
| U.S. Pat. No. 2,146,243 | May 26, 1938 | Feb. 7, 1939 | Nathan Aug | Combination apparel and handbag |
| U.S. Pat. No. 2,292,347 | Dec. 23, 1939 | Aug. 11, 1942 | Talon, Inc. | Apparel construction |
| U.S. Pat. No. 2,324,722 | Oct. 2, 1940 | Jul. 20, 1943 | Stanley Papierniak | Sport jacket |
| U.S. Pat. No. 2,825,902 | Oct. 20, 1955 | Mar. 11, 1958 | Marcus Breier Sons, Inc. | Apparel construction |
| U.S. Pat. No. 4,404,687 | Sep. 24, 1982 | Sep. 20, 1983 | Hager, Markus | Convertible outerwear and carrying bag |
| U.S. Pat. No. 4,476,587 | Jan. 4, 1983 | Oct. 16, 1984 | Itoi; Toru | Convertible apparel |
| U.S. Pat. No. 4,483,469 | Apr. 4, 1984 | Nov. 20, 1984 | Arisland; Bjoerg | Convertible carrier bag |
| U.S. Pat. No. 4,502,155 | Jun. 21, 1982 | Mar. 5, 1985 | Itoi; Toru | Outerwear and bag in one |
| U.S. Pat. No. 4,689,831 | Jun. 27, 1986 | Sep. 1, 1987 | Homebodies, Inc. | Convertible apparel |
| U.S. Pat. No. 5,123,117 | Mar. 13, 1991 | Jun. 23, 1992 | Prendergast; Gerard | Combination backpack and reversible jacket |
| U.S. Pat. No. 6,564,388 | Jan. 15, 2002 | May 20, 2003 | Poston Ody Merlin | Multi-purpose carry bag and method therefor |
| U.S. Pat. No. 8,032,948 | Feb. 19, 2008 | Oct. 11, 2011 | Anderson, Seth 1 | Garment with integral garment pack |

It is an object of the invention through a series of pockets to provide a sealable storage bag, such as a rucksack, bum bag (worn around the waist) or shoulder bag for items that can remain closed while the product goes through the transformation 5 into wearable apparel, such as a poncho, jacket, t-shirt, shirt, sweatshirt or sweater, for example, whereby the items are then accessible through a sealable opening in the face of the apparel, as with a traditional zip and pocket storage system.

Thus, it is an object of the invention to provide such a bag with dedicated storage which enables conversion of the bag into wearable apparel.

Another object of the invention is to provide a bag for containing and carrying apparel and other items without having the inherent problems of the prior art.

A further object of the invention is to provide apparel incorporating a bag which is substantially unseen when the apparel is worn, and does not alter the normal look of the apparel.

An additional object of the invention is to provide a bag with a dedicated space for storing items which is continuously accessible in use and when the bag is converted into apparel.

According to an aspect of the present invention there is provided a bag with a dedicated storage space for storing items, the bag being transformable into wearable apparel, the storage space being continuously accessible in use as a bag and after the bag is converted into apparel.

The present invention also provides a bag which is convertible into wearable apparel, the bag comprising a dedicated storage pocket, an apparel storage pocket which stores apparel fabric, and an internal panel which separates the dedicated and apparel storage pocket, the bag has a bag surface having an opening providing access to the dedicated storage pocket, and a bag reverse surface having an opening providing access to the apparel storage pocket, the internal panel has an opening, the bag is transformable between a bag configuration in which the apparel fabric is stored in the fabric storage pocket and the dedicated storage pocket is accessible through the sealable opening of the bag surface, and an apparel configuration in which apparel fabric is drawn out of the fabric storage pocket so as to cause the bag surface and bag reverse surface to become inverted so as to expose the internal panel and so as to form a bag component storage pocket into which the bag components are drawn and stored, the dedicated storage pocket is then accessible through the opening of the exposed internal panel.

The openings may be closable or "sealable" by a zip or other closing mechanism.

The opening of the bag reverse surface may be closed by a reversible zip.

Zip/s may be located horizontally and/or vertically.

The present invention also provides a bag which is convertible into wearable apparel, the bag having a dedicated, continuous storage compartment and being transformable between a bag mode in which apparel fabric is stored in a fabric storage compartment and an apparel mode in which said apparel fabric has been drawn out of said fabric storage compartment and said fabric storage compartment has been inverted to form a bag storage compartment into which bag components are drawn and stored, the continuous storage compartment being continuously accessible in said bag mode and in said apparel mode, whereby the contents of the continuous storage compartment do not have to be removed during transformation.

The present invention also provides a pocket system that integrates a bag and apparel, including a fabric storage compartment when in use as a bag, and a bag component storage compartment when in use as apparel, with a continuous compartment for storing items while as a bag, apparel and through conversion from bag to apparel and vice versa, when in a bag embodiment, the fabric of the apparel is drawn out of the fabric storage compartment, inverting said compartment, forming a new compartment into which the bag components are drawn and stored, when in apparel mode, the process is reversed to complete the transformation, i.e. the bag components are removed from the storage pocket, drawing the apparel material into the newly formed pocket.

In aspects and embodiments of the invention the apparel fabric may be a single layer material or a multi-layer material.

The bag may be, for example, a rucksack, a bum bag, or a shoulder bag. The apparel may be, for example, a poncho, a smock, a jacket, a t-shirt, a shirt, a sweatshirt or a sweater. Any combination of bag type and apparel type is possible.

The present invention also provides a pocket system to combine the functionality of a bag and apparel, comprising; three panels and access between those panels, forming a storage area for items to be kept and a storage area for apparel fabric or bag components, the pocket system comprises of; an outer layer; an intermediate layer; an inner layer; an elongate vertical or horizontal opening through the outer layer for hand access to the storage area; an elongate vertical or horizontal opening through the intermediate layer; an elongate vertical or horizontal zip on the inner layer for access to the compartment formed by the inner and intermediate layers; bag components attached to any point of the outside of the layers.

In some embodiments the main storage compartment can be left sealed while converting the bag into an item of apparel.

In some embodiments the bag may be reversed through the opening on the inner layer, presenting the apparel fabric contained within.

In some embodiments, upon reversal of the inner layer, bag components become stored in the newly created pocket; the reverse of the fabric storage pocket.

In accordance with the invention, a bag such as a rucksack (worn on the back or front), bum bag (worn around the waist) or shoulder bag (worn over the shoulder), (all encompassed herein by the term "bag") and the like is provided with means for expansion forming wearable apparel. For purposes of this application, apparel may be described as having an outer shell layer and an inner lining layer. Furthermore, either of these layers may in actuality comprise a plurality of individual panels of fabric, insulation materials, polymeric film, leather and the like.

The dedicated storage compartment is formed by the inner surfaces of the outer pocket of the apparel, and is accessed through the front sealable opening of the bag on the outside surface of the bag. The outside surfaces of the bag are formed by the inner surfaces of the inner pocket of the apparel.

Conversion into apparel entails opening the reversible zip on the back surface of the bag and removing the material that forms the apparel until the bag is stored in its own pocket, including any associated straps, clips and buckles.

An access opening into the storage compartment comprises a generally vertical or horizontal elongated sealable opening on the front of the apparel.

This position enables a wearer to place/remove objects into/from the dedicated storage compartment while wearing the outerwear.

Thus, the storage compartment is useful for carrying objects when configured as a bag but may be inverted to become the pocket of an item of apparel. Bungee cords and secondary pockets may be formed on the surface of the invertible pocket or any straps and extra bag attachments for the storage of extra items.

The invention may be formed of three panels and three zips or other closing mechanisms. The apparel may be a single layer material and may be enhanced with additional interlayers of fabric, insulation, etc. between the outer shell layer and the inner lining layer. The fabric also gives the bag its structure.

The combination of a bag and integrated apparel is particularly useful for outdoor wear whilst travelling, under changeable weather conditions or changing activity levels. The bag feature of the apparel may be configured to be very inconspicuous. Thus, the thickness dimension of the pocket system appears to be not much greater than the thickness of the other portions of the apparel.

References to "bag" and "apparel" may be reversed i.e. the invention may relate to apparel convertible into a bag.

Other objects and considerations of the invention will become apparent in the following detailed description of the invention when taken in conjunction with the attached drawings.

Further embodiments are disclosed in the dependent claims attached hereto.

Different aspects and embodiments of the invention may be used separately or together.

Further particular and preferred aspects of the present invention are set out in the accompanying independent and dependent claims.

Features of the dependent claims may be combined with the features of the independent claims as appropriate, and in combination other than those explicitly set out in the claims.

The present invention will now be more particularly described, by way of example, with reference to the accompanying drawings, in which.

Figure 7:
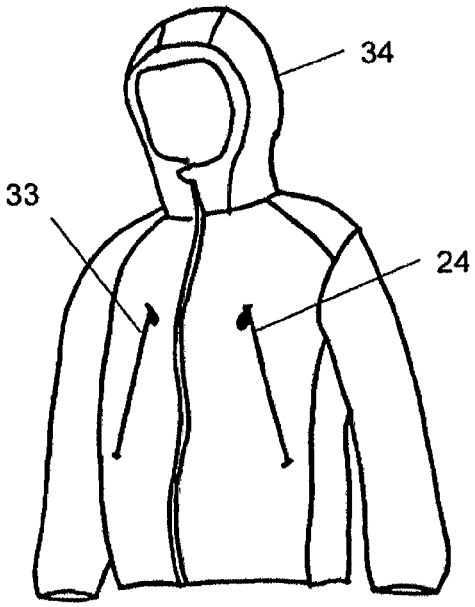
Figure 8:
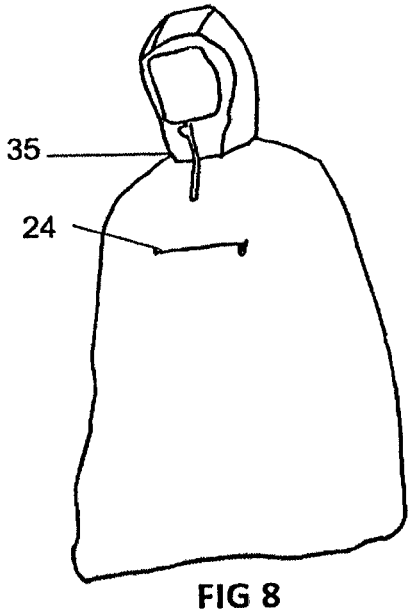
Figure 9:
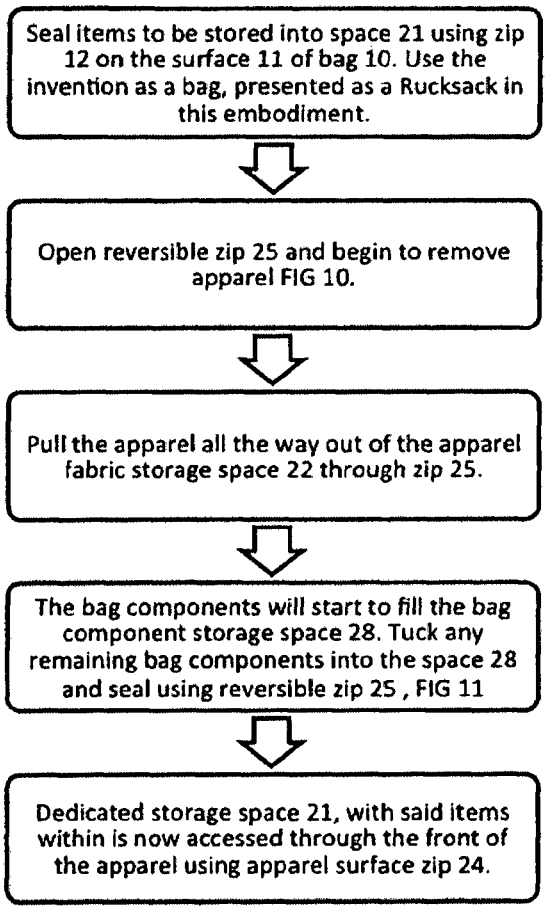
Figure 10:
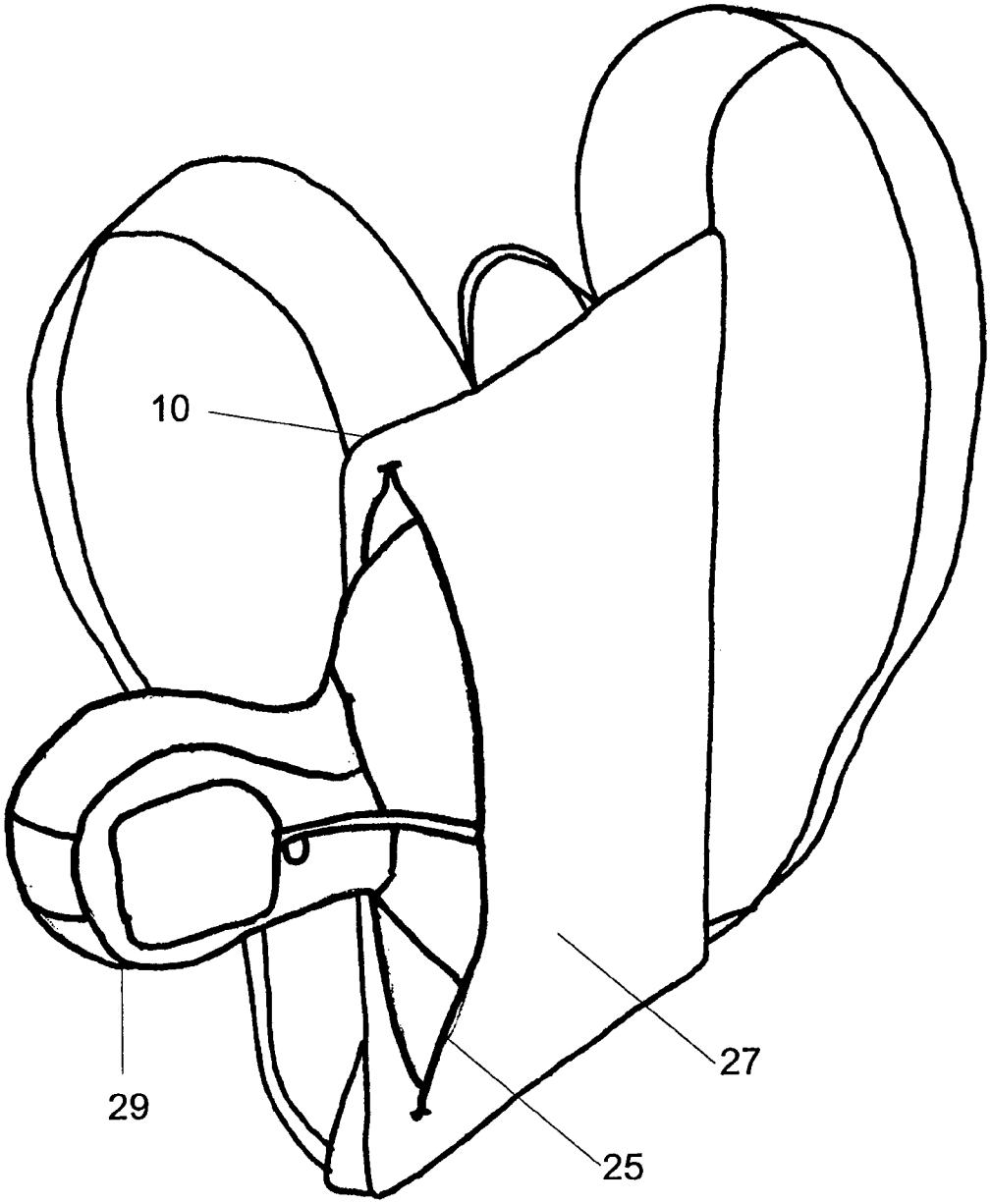

FIG. 7 a diagram of an embodiment of the invention as a jacket, with substantially vertically aligned zips as closure to the designated storage space and matching pocket;

FIG. 8 a diagram of an embodiment of the invention as a poncho, with substantially horizontally aligned zip as closure to the designated storage space;

FIG. 9 is a process flow chart showing a method for converting the bag, with apparel storage into an item of apparel with storage 5 for bag components FIG. 10 shows the initial removal of apparel stage of the conversion of the bag embodiment into the apparel embodiment in accordance with the invention.

Figure 1:
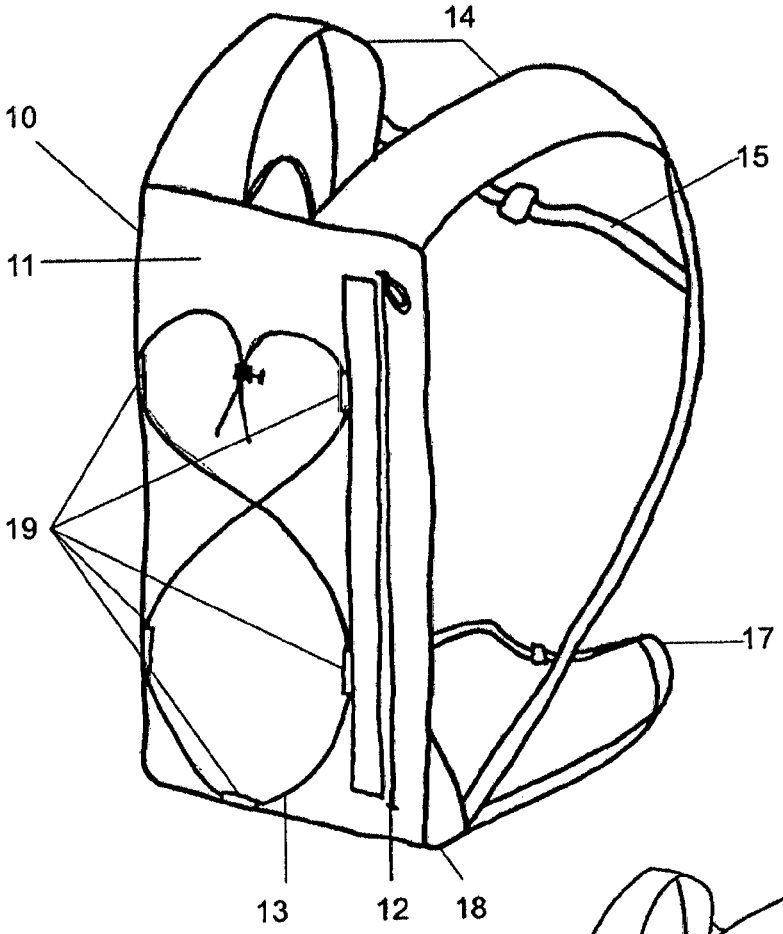
FIG. 1 is a general schematic frontal view of an embodiment of the invention as a rucksack, in accordance with the invention, with a vertical aligned zipped pocket for the opening of the dedicated storage compartment.
Figure 2:
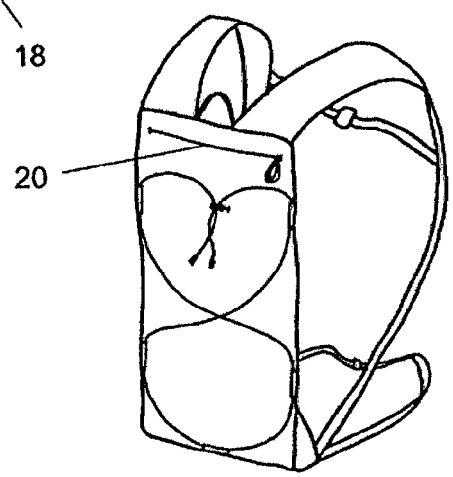
FIG. 2 is a general schematic frontal view of an embodiment of the invention as a rucksack with an alternate, horizontal zip arrangement for the opening of the dedicated storage compartment.
Figure 11:
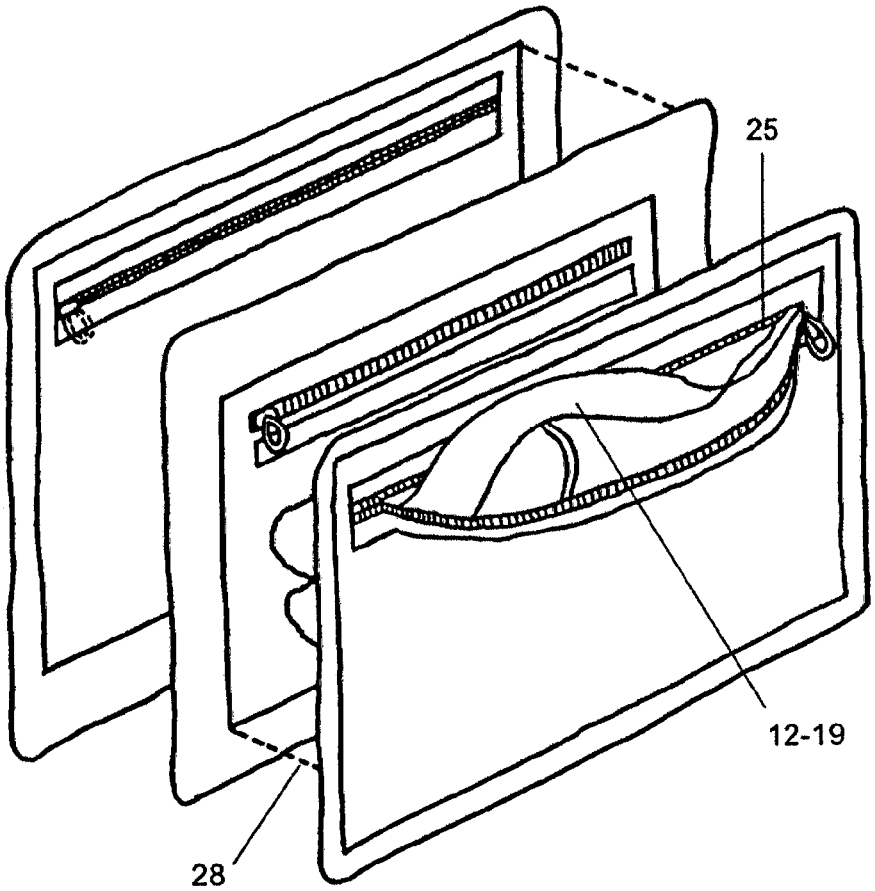

FIG. 11 shows the final stage of the bag components being stored in the internal apparel pocket The invention embodied as bag 10 is depicted in FIG. 1 and FIG. 2. Consisting of bag front surface A, 11, vertically aligned dedicated storage space bag zip 12 for access to the dedicated storage space 21 (FIG. 3), bungee cord 13 to hold extra items, straps 14 to hold this embodiment of the invention to the wearers torso, sternum strap 15 to secure the bag in place while in use, waist strap 17 for extra stability, reinforcement corners 18 to add strength and direction to the straps 14, bungee supports 19 to hold the bungee cord 13 in place. FIG. 2 presents an alternate arrangement of the vertically aligned dedicated storage space bag zip 12 as horizontally aligned dedicated storage space bag zip 20. Other configurations of this representation of the invention are possible including bum bag type waist attached bags and shoulder type bags, with associated horizontally or vertically aligned dedicated storage space bag zips.

Figure 3:
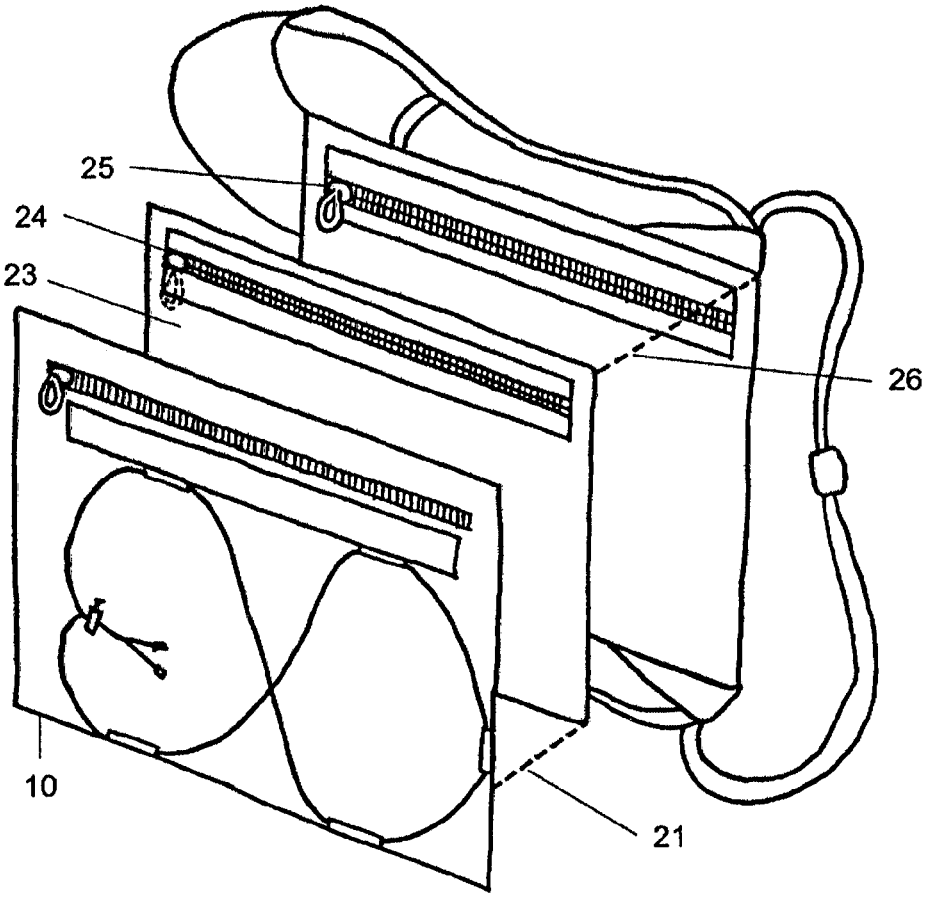
FIG. 3 is a perspective front view of the outer, inner and intermediate layers of the invention in exaggerated spaced-apart relationship.

FIG. 3 is an expanded front view of bag 10, showing the dedicated storage space 21, the internal dedicated storage space surface A, 23, used to separate the two storage pockets 21 and 26, the apparel surface zip 24 for accessing the items when in the apparel configuration, reversible zip 25 which facilitates transformation from a bag into apparel and, apparel fabric storage space 26 which contains the fabric for the apparel and helps to form the structure of the bag.

Figure 4:
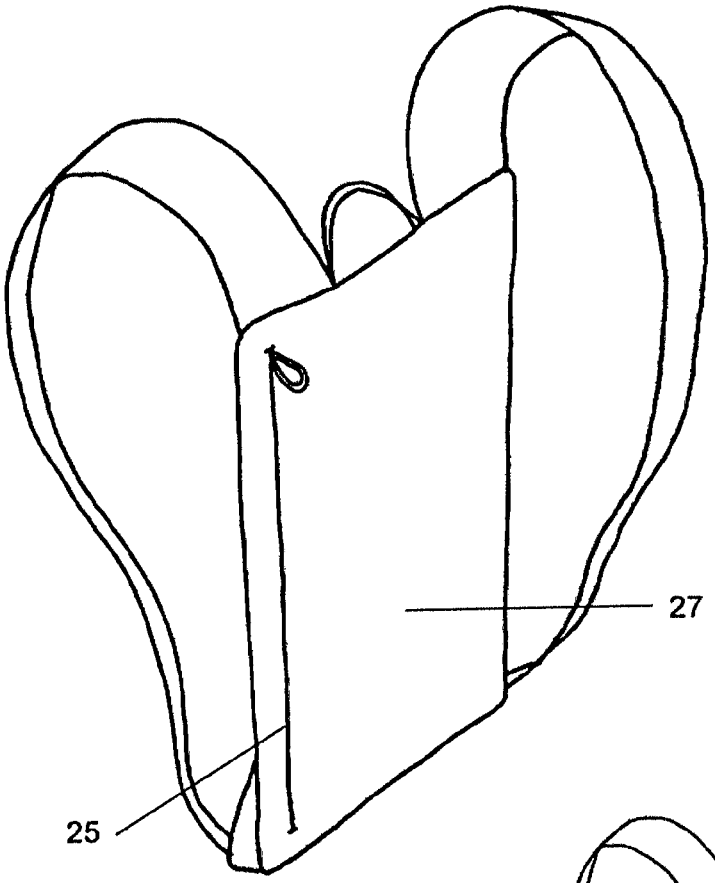
FIG. 4 is a general schematic reverse view of an embodiment of the invention as a rucksack, in accordance with the invention, with a vertical aligned zipped pocket for the opening of reversible apparel storage pocket.
Figure 5:
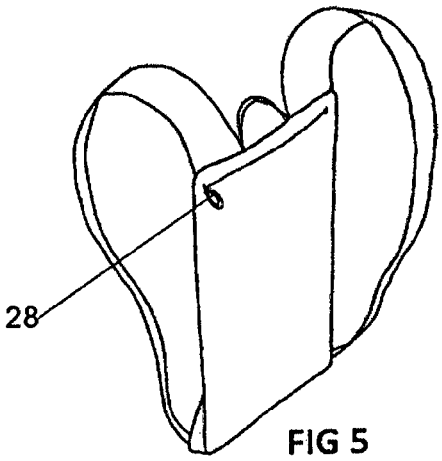
FIG. 5 is a general schematic reverse view of an embodiment of the invention as a rucksack with an alternate, horizontal zip arrangement for the of reversible apparel storage pocket.

The alignment of the invention in the state of a bag 10 is depicted in FIG. 4 and FIG. 5. consisting of the bag reverse surface 27. FIG. 4 specifically depicts the vertically aligned bag component/apparel fabric storage space reversible zip 25. FIG. 5 specifically depicts the horizontally aligned bag component/apparel fabric storage space reversible zip 28. The alignment of the zips effects the size of the access to the dedicated storage space 21 (FIG. 3), one may be preferable to the other depending on the nature of the items intended for the storage space.

Figure 6:
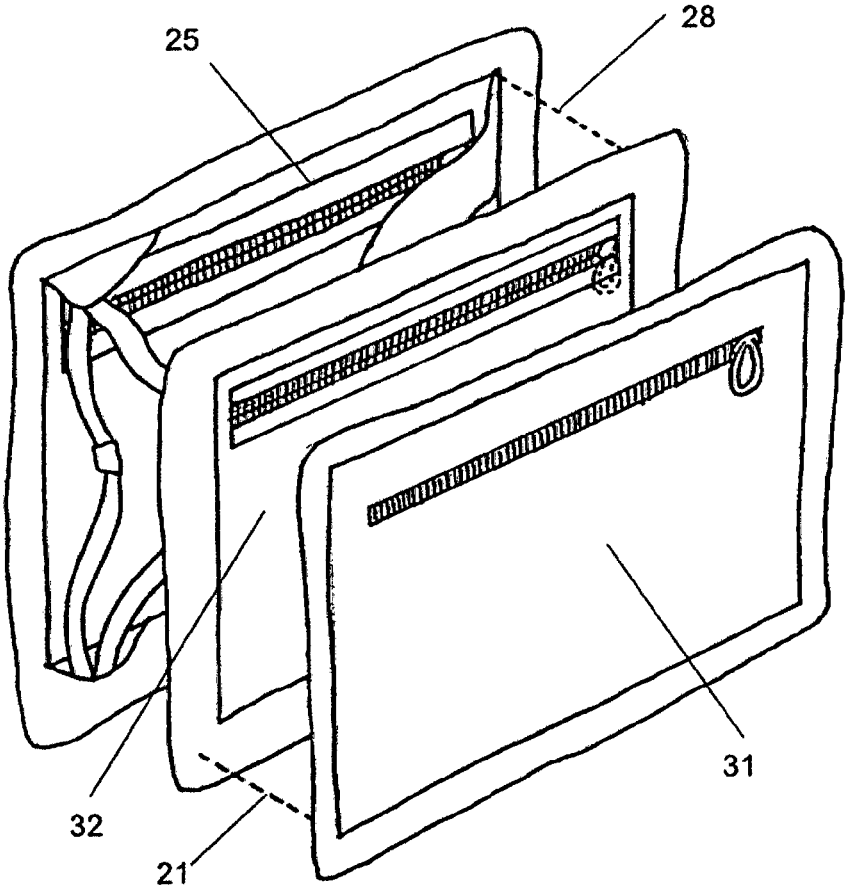
FIG. 6 is a perspective front view of the outer, inner and intermediate layers of the invention as it appears in the apparel embodiment in exaggerated spaced-apart relationship.

The alignment of the invention in the state of apparel is shown in FIG. 6, whereby the external apparel pocket panel 31 is visible on the outside of the 5 apparel, forming the dedicated storage space 21 with the intermediate panel made up from the internal dedicated storage space surface B. 32, and the internal dedicated storage space surface A. 23, (FIG. 3). The bag component storage space 28 contains the components of the bag 12-19 in this embodiment.

FIG. 7 shows the alignment of the apparel zip 24 applied to a jacket embodiment 34 of the invention, which can be balanced with the addition of an additional zip 33 to make the jacket look normal. FIG. 8 shows the application of the invention to a poncho or smock type embodiment 35 whereby the apparel zip 24 is aligned.

FIG. 9 shows the process diagram for converting the bag into the apparel. To convert the apparel back into the bag function, using the invention, the process is reversed with the beginning step being to open reversible zip 25 (FIG. 6) and remove the bag components, whilst either stuffing or folding the apparel fabric into the newly formed apparel fabric storage space 26 (FIG. 3).

FIG. 10 shows the beginning of the apparel conversion process, whereby reversible zip 25 on the reverse surface 27 of bag 10 is opened and the apparel fabric 29 is extracted. The entirety of the fabric is removed and as a result of the removal of the fabric, the front surface 11 (FIG. 1) and the reverse surface 27 become inverted, exposing the internal pocket surface panel.

FIG. 11 shows the final step of the conversion from the bag into the apparel, whereby the bag components 12-19 are stuffed into the bag component storage space 28 through the reversible zip 25, the apparel is then straightened out and ready to wear.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

It is evident to those skilled in the art that various changes and modifications may be made in the methods and apparatus of the invention as disclosed herein without departing from the spirit and scope of the invention as defined in the following claims.

The invention claimed is:

1. A bag convertible into wearable apparel, comprising:

a first panel comprising
  a first surface, and
  a second surface;

a second panel comprising
  a third surface, and
  a fourth surface;

a third panel comprising
  a fifth surface, and
  a sixth surface;

a first opening in the first panel;

a second opening in the second panel;

a third opening in the third panel;

wherein the bag has a bag configuration and an apparel configuration, wherein in the bag configuration, the first panel is disposed directly adjacent to the second panel, the second panel is disposed directly adjacent to the third panel, a dedicated storage space is defined between the second surface disposed directly adjacent to the third surface, and an apparel fabric storage space is defined between the fourth surface disposed directly adjacent to the fifth surface, and wherein in the apparel configuration, the second panel is disposed directly adjacent to the first panel, the third panel is disposed directly adjacent to the first panel, the dedicated storage space is defined between the third surface disposed directly adjacent to the first surface, and a bag component storage space is defined between the second surface disposed directly adjacent to the sixth surface.

2. The bag of claim 1, wherein an apparel fabric is a single layer material.

3. The bag of claim 1, wherein the apparel fabric is a multi-layer material.

4. The bag of claim 1, wherein the bag configuration is selected from a group consisting of a rucksack, a bum bag, and a shoulder bag.

5. The bag of claim 1, wherein the apparel configuration is selected from a group consisting of a poncho, a smock, a jacket, a t-shirt, a shirt, a sweatshirt, and a sweater.

6. The bag of claim 1, further comprising:
a first zip disposed in the first opening.

7. The bag of claim 1, further comprising:
a second zip disposed in the second opening.

8. The bag of claim 1, further comprising:
a third zip disposed in the third opening.

9. The bag of claim 1, further comprising:
a first zip disposed in the first opening;
a second zip disposed in the second opening; and
a third zip disposed in the third opening.

10. The bag of claim 8, wherein the third zip is reversible.

11. The bag of claim 9, wherein the third zip is reversible.

12. The bag of claim 1, further comprising at least one handle.

13. The bag of claim 1, further comprising at least one shoulder strap.

* * * * *